US012529541B2

(12) United States Patent
Spychalski

(10) Patent No.: US 12,529,541 B2
(45) Date of Patent: Jan. 20, 2026

(54) CARRY ASSIST HARNESS SYSTEM

(71) Applicant: Daniel Spychalski, Elgin, IL (US)

(72) Inventor: Daniel Spychalski, Elgin, IL (US)

( * ) Notice: Subject to any disclaimer, the term of this patent is extended or adjusted under 35 U.S.C. 154(b) by 582 days.

(21) Appl. No.: 17/359,608

(22) Filed: Jun. 27, 2021

(65) Prior Publication Data

US 2022/0412690 A1 Dec. 29, 2022

(51) Int. Cl.
*F41C 33/00* (2006.01)
*A45F 3/04* (2006.01)
*F41H 5/08* (2006.01)

(52) U.S. Cl.
CPC ..... *F41C 33/001* (2013.01); *A45F 3/04* (2013.01); *F41H 5/08* (2013.01); *A45F 2003/045* (2013.01); *A45F 2200/0591* (2013.01)

(58) Field of Classification Search
CPC .. F41C 33/002; F41H 5/08; A45F 3/04; A45F 3/06; A45F 2003/045; A45F 2200/0591
See application file for complete search history.

(56) References Cited

U.S. PATENT DOCUMENTS 4,571,783 A 2/1986 Kasai
4,637,099 A 1/1987 Kasai
4,688,337 A 8/1987 Dillner
4,864,700 A 9/1989 Kasai
5,799,851 A * 9/1998 Wulf ..... A45F 3/047 224/582
6,481,108 B1 * 11/2002 Helinski ..... B25H 1/0028 30/296.1
7,716,748 B2 5/2010 Dovner
8,028,880 B2 * 10/2011 Knowles ..... F16M 13/00 248/351
8,584,571 B2 11/2013 Armellino, Jr.
9,885,539 B2 2/2018 Spransy et al.
10,077,869 B2 * 9/2018 Semple ..... F16M 13/04
10,213,008 B2 2/2019 Weaver, Jr. et al.
10,555,596 B2 2/2020 de Geus
10,788,295 B2 9/2020 Spychalski
2005/0217472 A1 10/2005 Baker
2013/0098234 A1 4/2013 Armellino, Jr.
2016/0187106 A1 6/2016 Roberts et al.
2017/0038001 A1 2/2017 Semple et al.
2017/0167826 A1 6/2017 Spransy et al.
2018/0202771 A1 * 7/2018 Armellino ..... F41H 5/08

* cited by examiner

*Primary Examiner* — Bret Hayes
(74) *Attorney, Agent, or Firm* — Erickson Law Group, P.C.

(57) ABSTRACT

A carry harness system includes a support belt arranged to encircle a user's waist; a shoulder harness arranged to lay over the user's shoulders on opposite sides of the user's head; two front belt support straps arranged to be on a front side of the user and extending between the shoulder harness and the support belt; two rear belt support straps arranged to be on a rear side of the user and extending between the shoulder harness and the support belt; two post receivers supported on the support belt on the rear side; and two posts. The posts are arranged spaced-apart on the rear side, fit into the receivers and extending vertically between the post receivers and a vertical elevation above the shoulder harness. The two posts are fixed to the shoulder harness and have strap connections at tops of the posts. Two object support straps extend between the strap connections forwardly and obliquely to attachments on a rear side of the object to be carried.

13 Claims, 6 Drawing Sheets

CARRY ASSIST HARNESS SYSTEM

BACKGROUND OF THE INVENTION

Ballistic shields for law enforcement are known, such as disclosed in US Published Patent Application 2017/0038001; 2013/0098234; 2016/0187106, and U.S. Pat. Nos. 10,555,596; 10,788,295 and 10,213,008, all herein incorporated by reference to the extent the references are not contrary to the present disclosure.

The present inventor has recognized that it would be advantageous to provide a body-carried carrier system that is effective to support front loads, such as ballistic shields, and that was easily adjusted for a variety of different-size wearers.

The present inventor has recognized that it would be advantageous to provide an effective body-carried ballistic shield that included a guide and aiming arrangement for a shouldered weapon.

SUMMARY

An exemplary embodiment of the invention provides a carry harness system, comprising:

- a body-supported harness assembly;
- at least one post arranged on the rear side, supported from the body-supported harness assembly and extending vertically to a vertical elevation above the shoulder harness,
- the post fixed to the body-supported harness assembly and having a strap connection at a top of the post;
- an object support strap extending between the strap connection forwardly and obliquely to an attachment on a rear side of the object to be carried.

The exemplary embodiment of the invention can comprise:

- a support belt arranged to encircle a user's waist;
- a shoulder harness arranged to lay over the user's shoulders on opposite sides of the user's head;
- at least one front belt support strap arranged to be on a front side of the user and extending between the shoulder harness and the support belt;
- at least one rear belt support strap arranged to be on a rear side of the user and extending between the shoulder harness and the support belt;
- at least one post arranged on the rear side, supported from the support belt and extending vertically between the support belt and a vertical elevation above the shoulder harness, the post fixed to the shoulder harness and having a strap connection at a top of the post;
- an object support strap extending between the strap connection forwardly and obliquely to an attachment on a rear side of the object to be carried.

An embodiment carry harness system enables a person to carry a heavy object without the use of the hands. This system allows a person to carry heavy objects while allowing the person to handle other objects. The embodiment includes the benefit of allowing the user fast movements by transitioning the carried weight into the strongest load bearing muscle groups and skeletal structure, the legs and hips. The embodiment is easily fitted for deployment to the user by the user alone.

The system can include multiple straps that go over and around the user's shoulders and back in addition to a belt harness. The belt harness has plural upright posts that mount into vertically adjustable mounts to accommodate heights of different users. The system can include two upright posts extend upward from mounts supported on the support belt and are retained laterally in an adjustable lateral mount of which the adjustability is to accommodate a variety of widths to fit a particular user's shoulder width. The upper portion of the upright posts can extend above the user's shoulders to varying degrees of height adjustability, having end mounts that can accommodate a variety of fastener types, which may allow rapid detachment and attachment of the carried heavy object, such as a ballistic shield.

An exemplary embodiment carry harness system includes a support belt arranged to encircle a user's waist; a shoulder harness arranged to lay over the user's shoulders on opposite sides of the user's head; at least one front belt support strap arranged to be on a front side of the user and extending between the shoulder harness and the support belt; at least one rear belt support strap arranged to be on a rear side of the user and extending between the shoulder harness and the support belt; and two post receivers supported on the support belt on the rear side; and two posts. The posts are arranged spaced-apart on the rear side, fit into the receivers and extending vertically between the post receivers and a vertical elevation above the shoulder harness. The two posts are fixed to the shoulder harness and have strap connections at tops of the posts. Two object support straps extend between the strap connections forwardly and obliquely to attachments on a rear side of the object to be carried.

The attachments can each comprise a ring attached to the object to be carried. An anchor can be attached to the object below the ring, wherein each object support strap is threaded through the ring and extends downward to be attached to the anchor.

The object can be a ballistic shield.

The receiver can be a tube having a pin extending into a central channel of the tube, wherein the post extends into the tube and includes vertically spaced-apart adjustment holes. The adjustment holes are vertically positionable to align a select one adjustment hole to receive the pin to set an elevation of the post.

A horizontal member can be connected between the two posts at a vertical position above the receivers to set a spacing of the posts at a shoulder region of the user.

Advantageously, the vertical elevation of the top of the posts is located vertically between a top of a user's head and a top of a user's shoulders.

Each post can be surrounded by padding along a substantial portion of its length.

The shoulder harness can include a mat on a front side thereof and spaced-apart shoulder straps on a rear side thereof, the rear belt support straps can be connected at top ends thereof to bottom ends of the shoulder straps. The rear belt support straps can be connected together by a lateral strap.

One exemplary embodiment of the invention provides that the top ends of the posts extend above the user's shoulders but below the user's head. With this configuration an effective elevation is achieved to support a ballistic shield, for example, but the elevation is not so high as to be vulnerable to projectiles, i.e., the top of the posts can be below the uppermost extent of the shield.

From the foregoing, it will be observed that numerous variations and modifications may be effected without departing from the spirit and scope of the invention. It is to be understood that no limitation with respect to the specific apparatus illustrated herein is intended or should be inferred.

DETAILED DESCRIPTION

Figure 1:
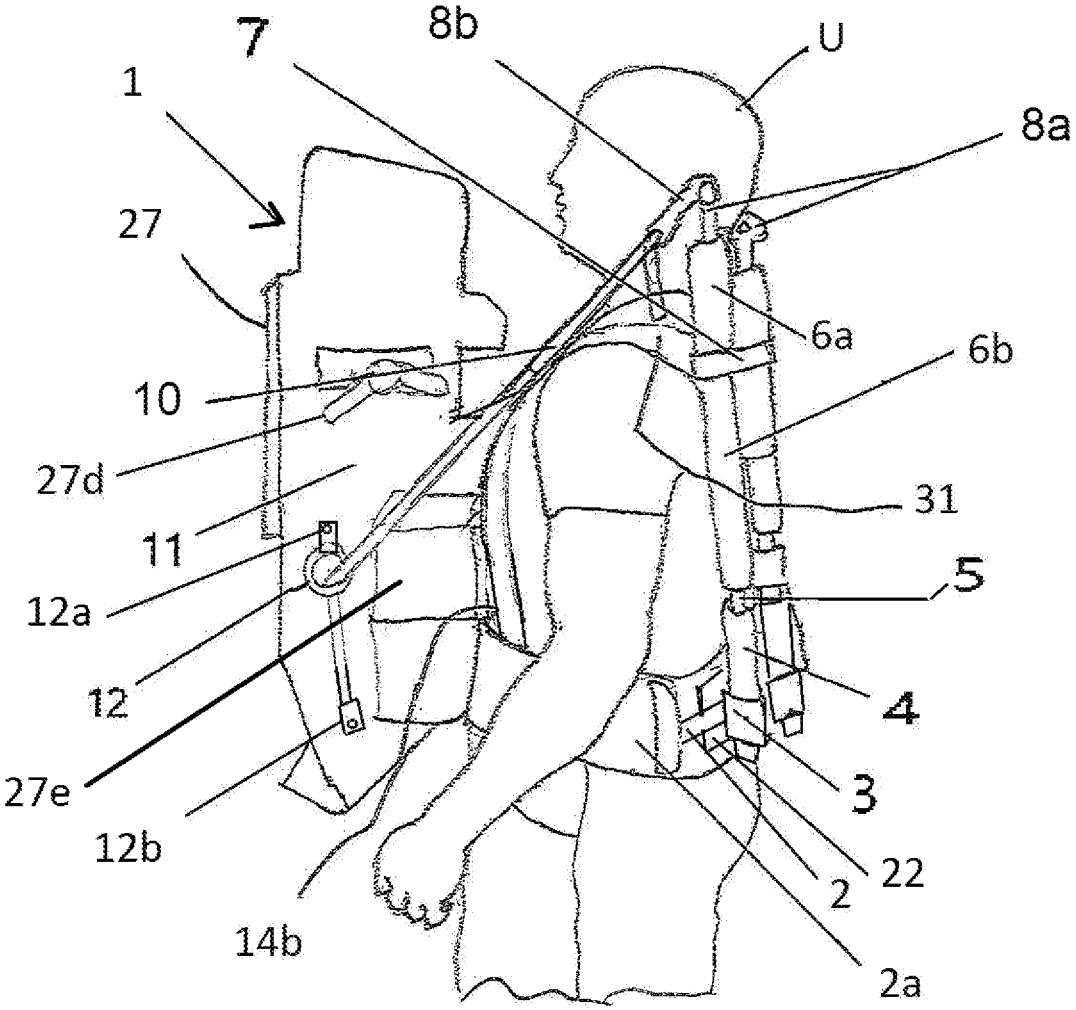
FIG. 1 is a rear perspective view of a carrier carried on a user.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

This application incorporates by reference U.S. Pat. No. 8,584,571 in its entirety, and also particularly for descriptions of the ballistic shield and straps, strap attachments, strap adjusters and buckles, to the extent that it is not contrary to the present disclosure.

Figure 2:
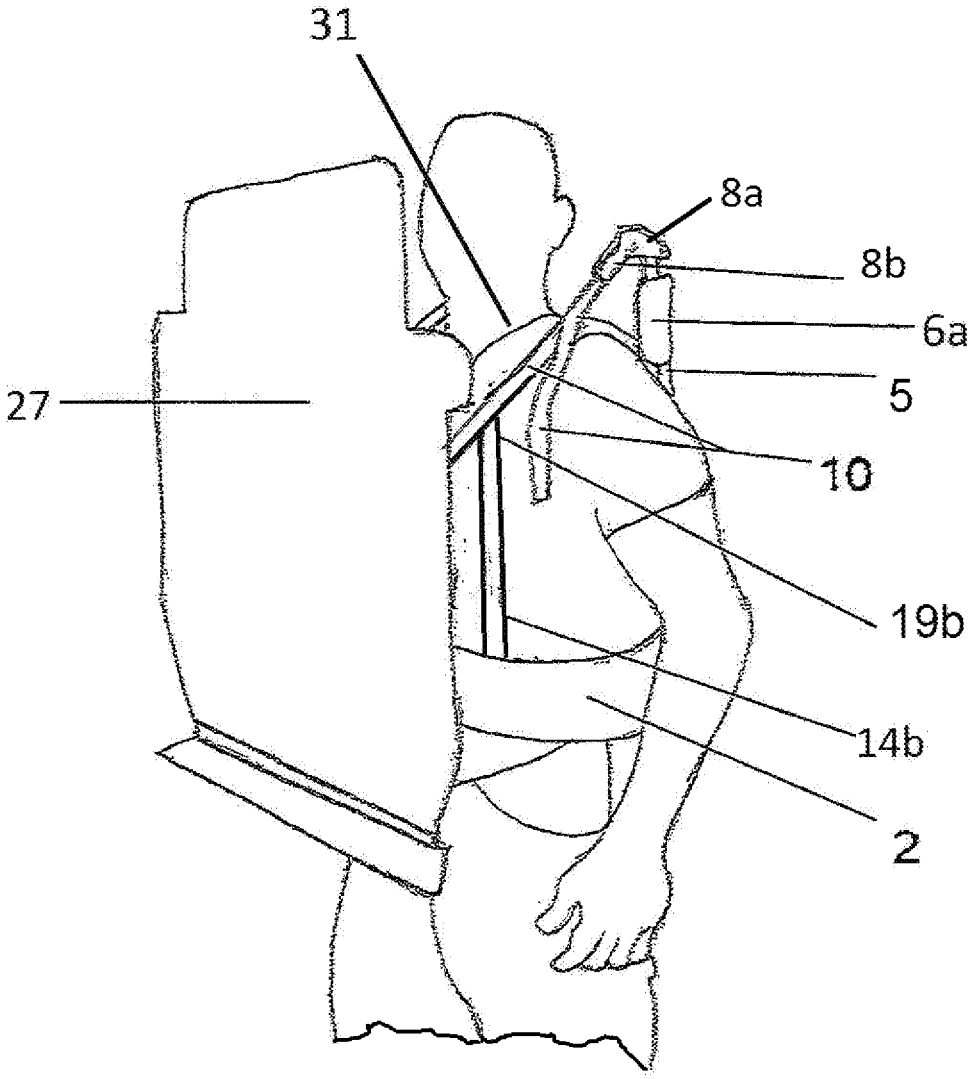
FIG. 2 is a front perspective view of the carrier mounted on a user shown in FIG. 1.
Figure 3:
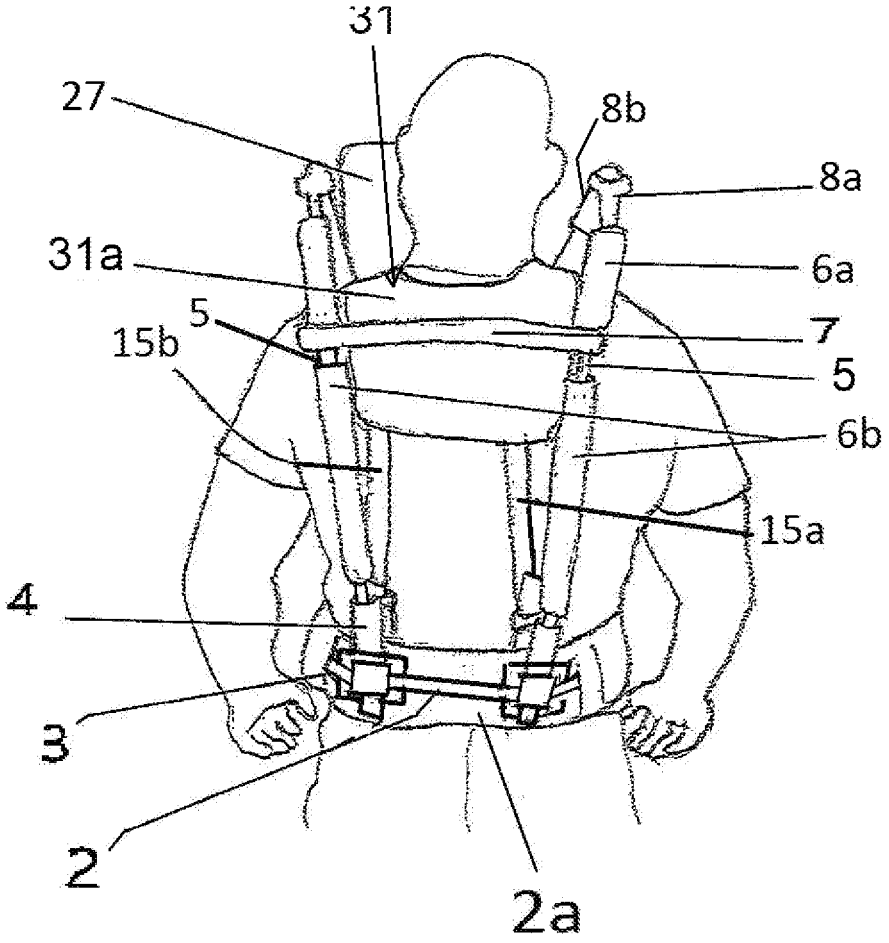
FIG. 3 is a rear view of the carrier mounted on a user shown in FIG. 1.

FIGS. 1-3 illustrates a carrier or body-supported harness assembly 1 mounted on a user "U." The carrier 1 can include a support belt 2 threaded through a waist band 2*a*, and a shoulder harness 31. The waist band 2*a* and shoulder harness 31 are connected via front belt support straps 14*a*, 14*b*, and rear belt support straps 15*a*, 15*b*. The support straps 14*a*, 14*b*, 15*a*, 15*b* can be directly sewn to the waist band 2*a* or to the belt 2, or the waist band, or the belt can have first buckle parts sewn thereto and the straps 14*a*, 14*b*, 15*a*, 15*b* can have cooperating second buckle parts sewn thereto to snap connect to the first buckle parts.

The support straps 15*a*, 15*b* can be directly sewn to the shoulder harness 31 (to a rear mat 31*a*), or the shoulder harness 31 can have first buckle parts sewn thereto and the straps 15*a*, 15*b* can have cooperating second buckle parts sewn thereto to snap connect to the first buckle parts. The support belt 2 can be sewn to the waist band 2*a* in a few places 2*b*, 2*c* (FIG. 7) to integrate the two together for mutual support, while still being able to function as a drawstring to tighten the combination belt 2 and waist band 2*a* around a variety of users having different waist measurements.

Figure 7:
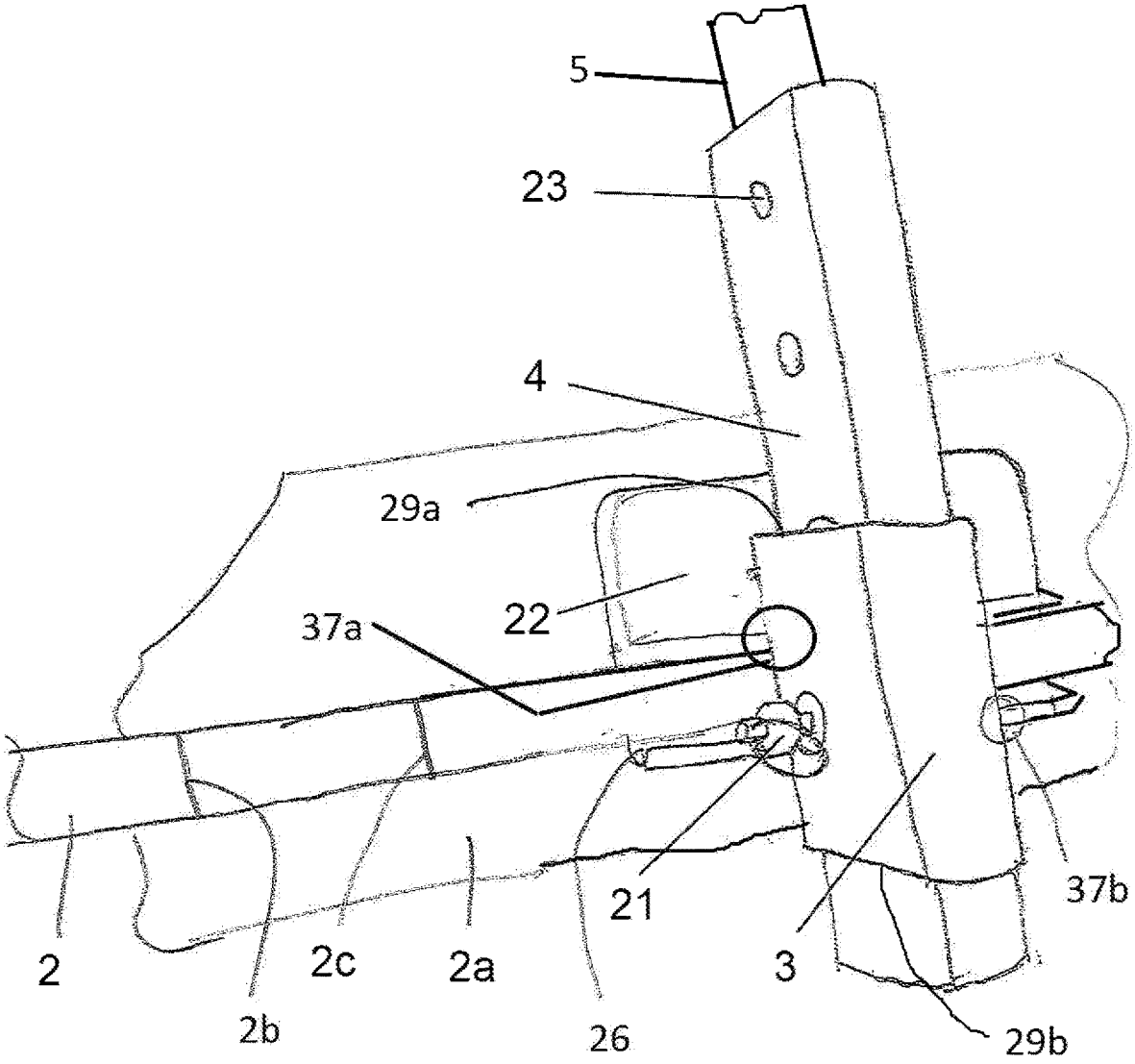
FIG. 7 is an enlarged, fragmentary perspective view of a portion of FIG. 4.

One or more mounting provisions, such as a post mount receiver 3 as shown in FIGS. 1, 3 and 7 are provided at a rear of the waist band 2*a*, supported by the belt 2 and waist band 2*a*. According to the illustrated embodiment, two mounting provisions are shown. The post mount receiver 3 is connected at positions 37*a*, 37*b*, for example, to a MOLLE strap mount 22, which can be attached to the waist band 2*a*, or simply held against the waist band 2*a* by the belt 2. The strap mount 22 can be a plate that is supported by the belt 2 or the waist band 2*a*. The post mount receiver 3 can be supported by the support belt 2 by being threaded between the receiver 3 and the strap mount 22, as shown in FIG. 7.

The waist band 2*a* as shown in FIG. 2 can be connected and suspended from above by the shoulder harness 31 by way of the belt support straps 14*a*, 14*b*, 15*a*, 15*b* at side waist areas of the user, which prevents the support belt 2 and waist band 2*a* from being forced too low under the weight of a carried object such as a ballistic shield 27 as shown in FIGS. 1 and 2.

The post mount receiver 3 can be a substantially rectangular tube with top and bottom openings 29*a*, 29*b*, which receives a post adjustment adapter 4 therein which includes vertically spaced-apart adjustment holes 23 located in a side portion of the adapter as shown in FIG. 7. An adjustment lock pin 21 as shown in FIG. 7 is carried by the receiver 3 in a fixed vertical position and can be a spring-loaded ball plunger pin that is in a normally extended position which inserts into a selected adjustment hole 23 in the adapter 4. This locks the position of the adapter 4 with respect to the receiver 3. The lock pin 21 is retractable by the user to permit the post adjustment adapter 4 to move vertically with respect to the receiver 3 to allow for vertical adjustability, by the selection of a different adjustment hole 23. An upright carry post 5 can be attached to, or made integral with, each adapter 4 and extends upward from each adapter 4.

A shoulder harness 31 is supported by the user's shoulders as shown in FIG. 3. The shoulder harness includes a rear mat 31*a* and front shoulder straps 19*a*, 19*b* sewn thereto. The shoulder harness can control the lateral spacing of carry posts 5 by way of a width adjuster 7 connected to the mat 31*a*, which can include a length-selected horizontal rod or bar affixed to each of the two carry posts 5. In other embodiments, the width adjuster 7 may be adjustable in length to alter the spacing of the carry posts or in other embodiments could use multiple straps or similar material to control the inboard and outboard positioning of the upper portion of the carry posts 5 to match a variety of different user's shoulder widths. Alternatively, each of the carry posts 5 can be strapped directly to the mat 31*a*, if needed for lateral stability.

Above the width adjuster 7 is a shoulder pad 6*a* that can be a cylindrical shaped foam, surrounding each carry post, providing protection for the user's rear-of-shoulder area. Below the width adjuster 7 is a shoulder pad 6*b* that can be a cylindrical shaped foam, surrounding each carry post providing protection for the user's back area. On top of each carry post is a suspending connector 8*a* which contains a D-shaped opening permitting the attachment of object support straps 10, and a strap adjuster 8*b* as shown in FIG. 2. The strap adjuster allows a length adjustment of the object support straps 10. The strap adjuster 8*b* can be conventional strap length adjuster as described in U.S. Pat. No. 4,571,783 or 4,637,099 herein incorporated by reference.

Each object support strap 10 extends downward obliquely and passes through a mounting ring 12 that is fixed to a back side 11 of the ballistic shield by a combination strap-and-fastener 12*a*. The combined strap-and-fastener 12*a* includes a short strap attached to the ring and a fastener attached to the shield 27. From the ring 12, the object support strap 10 extends down to a combination strap-and-fastener 12*b* fastened to a backside of the ballistic shield. The combined strap-and-fastener 12*b* includes a short strap attached to the strap 10 and a fastener attached to the shield 27.

Alternatively, two spaced-apart object support straps 10 can extend obliquely down to be clipped to a transversely arranged suspending coupler (not shown), which then couples to a pair of spaced-apart device straps which then pass obliquely down through spaced apart rings 12 fixed to a back side of the ballistic shield by combination strap-and-fasteners 12*a*. The object support straps 10 then extend down to combination strap-and-fasteners 12*b* fastened to a backside of the shield. This type of assembly is described in U.S. Pat. No. 8,584,571 herein incorporated by reference.

The shield also includes a handle 27*d* and pads 27*e* as described in U.S. Pat. No. 8,584,571, herein incorporated by reference.

Figure 4:
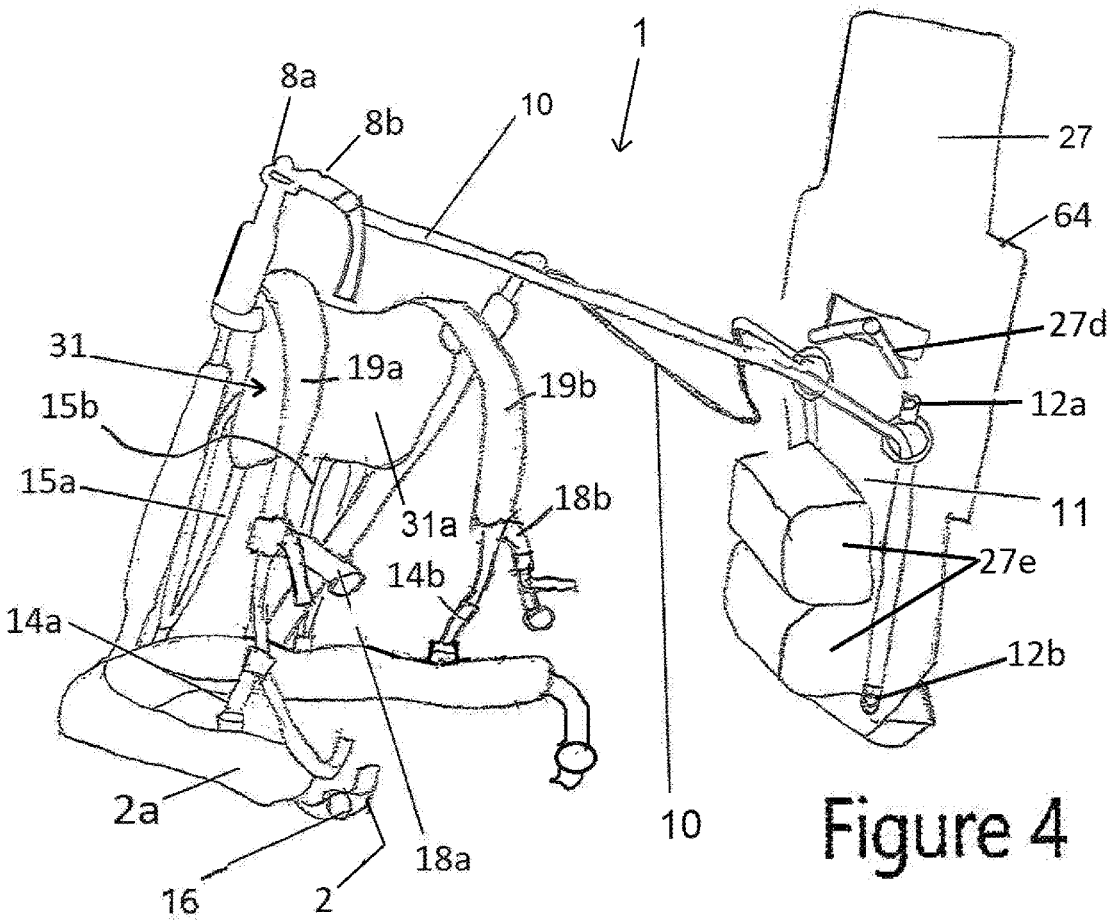
FIG. 4 a perspective view of the carrier shown in FIG. 1.
Figure 5:
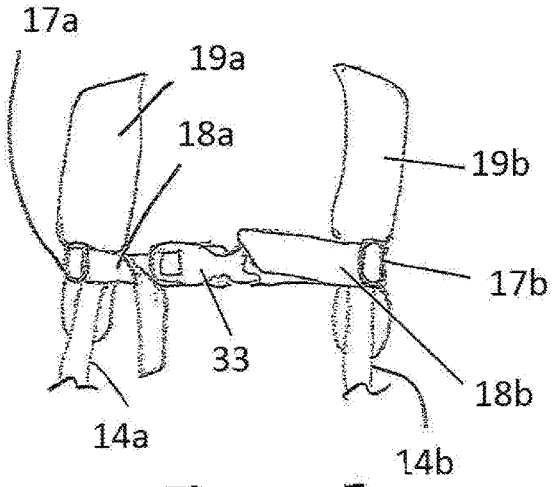
FIG. 5 is a fragmentary view of a rear portion of the carrier of FIG. 4.

FIGS. 4 and 5 display shoulder straps 19*a*, 19*b* connected together by transverse coupler straps 18*a*, 18*b* that are connected together by a coupler strap buckle 33. The coupler straps 18*a*, 18*b* can be directly sewn to the shoulder straps 19*a*, 19*b*, or the coupler straps 18*a*, 18*b* can have first buckle parts sewn thereto and the shoulder straps 19*a*, 19*b* can have cooperating second buckle parts to snap connect to the first buckle parts. Shoulder strap adjustment clips 17*a*, 17*b* provides an adjustment method for the straps 18 to be looped through and lengthened or shortened to increase or decrease width at the chest area. The buckle can be a conventional buckle such as a FASTEX® side release buckle or as described in U.S. Pat. No. 4,688,337 or 4,864,700 herein incorporated by reference. The adjustment clips 17*a*, 17*b* can be conventional strap length adjusters as described in U.S. Pat. No. 4,571,783 or 4,637,099 herein incorporated by reference.

Figure 6:
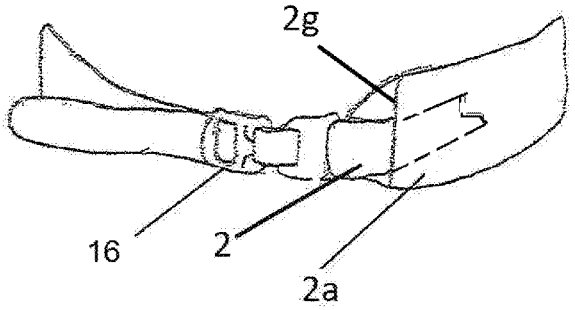
FIG. 6 is a fragmentary view of a rear portion of the carrier of FIG. 4.

FIGS. 4 and 6 show the support belt 2 and the support belt buckle 16 with the belt support straps 14*a*, 14*b*, 15*a*, 15*b* that couple the shoulder harness 31 to the waist band 2*a*. The buckle can be a conventional buckle such as a FASTEX® side release buckle or as described in U.S. Pat. No. 4,688,337 or 4,864,700 herein incorporated by reference.

FIG. 6 displays the support belt 2 threaded through a channel 2*g* in the waist band 2*a* and the support belt buckle 16 connecting free ends of the support belt 2.

Figure 8:
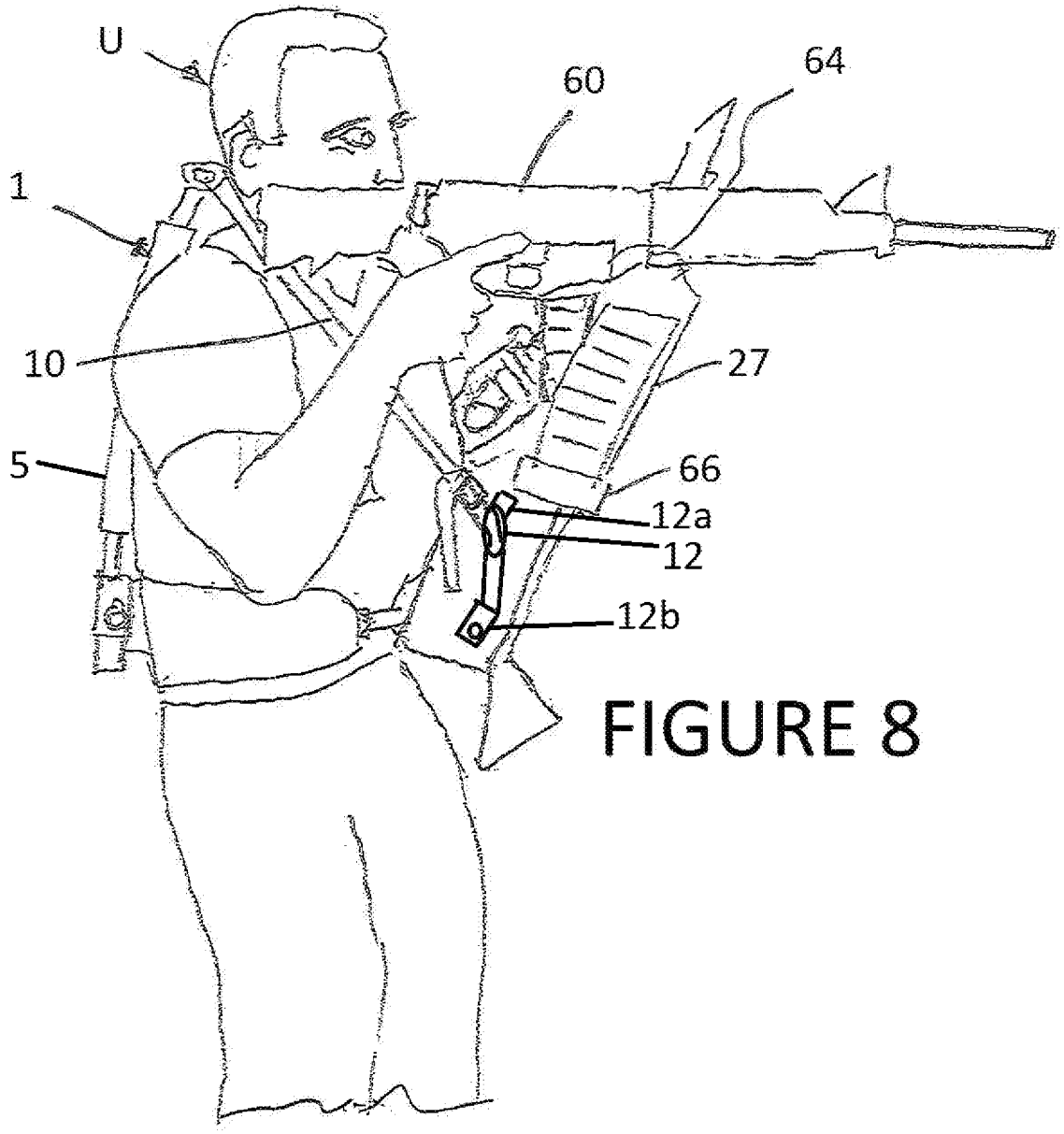
FIG. 8 is a front perspective view of the carrier carried on a user, the user shouldering a weapon.

FIG. 8 illustrates the support assembly 1 supporting a ballistic shield 27 with the user "U" shouldering a rifle 60. The rifle 60 can be supported on a guide 64 as part of the shield 27 for aiming the rifle. The shield can include a magazine holder 66 for holding a replacement, loaded, magazine 68 which can be engaged to an empty well of the rifle in a quick fashion by following a guide surface on the shield. These shield functions are more fully described in U.S. Pat. No. 10,788,295, herein incorporated by reference.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A carry harness system, comprising:

a body-supported harness assembly having a belt portion;

a post arranged on a rear side of the body-supported harness assembly, supported from the body-supported harness assembly and extending vertically to a vertical elevation above the shoulder harness, the post fixed to the body-supported harness assembly and having a strap connection at a top of the post;

an object support strap extending from the strap connection forwardly and obliquely to an attachment on a rear side of the object to be carried; and wherein the post fits into a receiver on the belt portion of the body-supported harness, the receiver comprises a tube having a pin removable from, and extendable into, a central channel of the tube, wherein the post includes an adapter that extends into the tube and includes vertically spaced-apart adjustment holes to adjust the vertical position of the post, wherein the adjustment holes are vertically positionable to align a select one adjustment hole to receive the pin to set an elevation of the post.

2. The system according to claim 1, wherein the attachments each comprise a ring attached to the object to be carried and an anchor attached to the object below the ring, each object support strap threaded through the ring and extending downward to be attached to the anchor.

3. A carry harness system, comprising:

a support belt arranged to encircle a user's waist;

a shoulder harness arranged to lay over the user's shoulders on opposite sides of the user's head;

at least one front belt support strap arranged to be on a front side of the user and extending from the shoulder harness to the support belt;

at least one rear belt support strap arranged to be on a rear side of the user and extending from the shoulder harness to the support belt;

two posts arranged spaced-apart on the rear side, supported from the support belt by vertically adjustable mechanisms, and extending vertically from the support belt to a vertical elevation above the shoulder harness, the two posts fixed to the shoulder harness and having strap connections at tops of the posts;

two object support straps extending from respective strap connections forwardly and obliquely to respective attachments on a rear side of the object to be carried.

4. The system according to claim 3, wherein the object comprises a ballistic shield.

5. The system according to claim 3, wherein the vertically adjustable mechanisms comprise two receivers, each receiver comprises a tube having a pin extending into removable from, and extendable into, a central channel of the tube, wherein the post extends into the tube and includes an adapter that includes vertically spaced-apart adjustment holes, wherein the adjustment holes are vertically positionable to align a select one adjustment hole to receive the pin to set an elevation of the post.

6. The system according to claim 3, further comprising a horizontal member connected between the two posts at a vertical position above the receivers to set a spacing of the posts at a shoulder region of the user.

7. The system according to claim 3, wherein the vertical elevation is located vertically between a top of a user's head and a top of a user's shoulders.

8. The system according to claim 3, wherein the at least one rear belt support strap comprises two spaced apart rear belt support straps, and the rear belt support straps are connected together by a lateral strap.

9. The system according to claim 3, comprising two post receivers supported on the support belt on the rear side;

said two posts fit into the two post receivers and extending vertically from the two post receivers to the vertical elevation above the shoulder harness.

10. The system according to claim 3, wherein each post is surrounded by padding along a substantial portion of its length.

11. The system according to claim 3, where the shoulder harness comprises a mat on a rear side thereof and spaced-apart shoulder straps on a rear side thereof, the at least one rear belt support strap comprises two spaced apart rear belt support straps, and the rear belt support straps connected at top ends thereof to bottom ends of the shoulder straps.

12. A carry harness system, comprising:

a support belt arranged to encircle a user's waist;

a shoulder harness arranged to lay over the user's shoulders on opposite sides of the user's head;

at least one front belt support strap arranged to be on a front side of the user and extending from the shoulder harness to the support belt;

at least one rear belt support strap arranged to be on a rear side of the user and extending from the shoulder harness to the support belt;

two posts arranged spaced-apart on the rear side, supported from the support belt, and extending vertically from the support belt to a vertical elevation above the shoulder harness, the two posts fixed to the shoulder harness and having strap connections at tops of the posts;

two object support straps extending from respective strap connections forwardly and obliquely to respective attachments on a rear side of the object to be carried;

wherein each post is surrounded by padding along a substantial portion of its length.

13. A carry harness system, comprising:

a support belt arranged to encircle a user's waist;

a shoulder harness arranged to lay over the user's shoulders on opposite sides of the user's head;

at least one front belt support strap arranged to be on a front side of the user and extending from the shoulder harness to the support belt;

at least one rear belt support strap arranged to be on a rear side of the user and extending from the shoulder harness to the support belt;

two posts arranged spaced-apart on the rear side, supported from the support belt by vertically adjustable mechanisms, and extending vertically from the support belt to a vertical elevation above the shoulder harness, the two posts fixed to the shoulder harness and having strap connections at tops of the posts;

two object support straps extending from respective strap connections forwardly and obliquely to respective attachments on a rear side of the object to be carried;

wherein the shoulder harness comprises a mat on a rear side thereof and spaced-apart shoulder straps on a rear side thereof, the at least one rear belt support strap comprises two spaced apart rear belt support straps, and the rear belt support straps connected at top ends thereof to bottom ends of the shoulder straps.

* * * * *